US008143868B2

(12) United States Patent
Dasgupta et al.

(10) Patent No.: US 8,143,868 B2
(45) Date of Patent: Mar. 27, 2012

(54) INTEGRATED LDO WITH VARIABLE RESISTIVE LOAD

(75) Inventors: Uday Dasgupta, Singapore (SG); Alexander Tanzil, Singapore (SG)

(73) Assignee: MediaTek Singapore Pte. Ltd., Singapore (SG)

( * ) Notice: Subject to any disclaimer, the term of this patent is extended or adjusted under 35 U.S.C. 154(b) by 378 days.

(21) Appl. No.: 12/542,720

(22) Filed: Aug. 18, 2009

(65) Prior Publication Data

US 2010/0066320 A1 Mar. 18, 2010

Related U.S. Application Data

(60) Provisional application No. 61/096,865, filed on Sep. 15, 2008.

(51) Int. Cl.
*G05F 1/40* (2006.01)

(52) U.S. Cl. ..... 323/273

(58) Field of Classification Search ..... 323/265–267, 323/279–282, 351; 327/538, 540, 543
See application file for complete search history.

(56) References Cited

U.S. PATENT DOCUMENTS

| | | | | |
|---|---|---|---|---|
| 5,850,139 | A | 12/1998 | Edwards | |
| 6,556,083 | B2 | 4/2003 | Kadanka | |
| 7,402,987 | B2 * | 7/2008 | Lopata | 323/282 |
| 7,531,996 | B2 * | 5/2009 | Yang et al. | 323/282 |
| 2009/0115382 | A1 * | 5/2009 | Hasegawa et al. | 323/273 |
| 2009/0322295 | A1 * | 12/2009 | Scoones et al. | 323/282 |
| 2010/0066169 | A1 * | 3/2010 | Apfel | 307/31 |

* cited by examiner

*Primary Examiner* — Adolf Berhane
(74) *Attorney, Agent, or Firm* — Winston Hsu; Scott Margo

(57) ABSTRACT

To provide adequate compensation for a wide range of output loads, a low dropout (LDO) regulator has an amplifier, a pass transistor, a voltage divider, a compensation network, and a control circuit. The amplifier outputs a comparison result according to a reference signal and a feedback signal. The pass transistor generates an output current based on the comparison result of the amplifier. The voltage divider generates the feedback signal according to the output current. The compensation network couples the output of the pass transistor to a low-impedance node of the amplifier, and has a compensation capacitor and a variable resistor coupled to the compensation capacitor. The control circuit is coupled to the input of the pass transistor and to the variable resistor for controlling resistance of the variable resistor according to the output current of the pass transistor.

9 Claims, 8 Drawing Sheets

INTEGRATED LDO WITH VARIABLE RESISTIVE LOAD

CROSS REFERENCE TO RELATED APPLICATIONS

This application claims the benefit of U.S. Provisional Application No. 61/096,865, filed on Sep. 15, 2008 and entitled "Adaptive Compensation for Integrated LDO with Variable Load," the contents of which are incorporated herein by reference.

BACKGROUND OF THE INVENTION

1. Field of the Invention

The present invention relates to low dropout regulators, and particularly, to an integrated LDO with a variable resistive load compensation scheme.

2. Description of the Prior Art

Voltage regulator circuits are circuits placed between a power supply and a load circuit for providing a constant voltage to the load circuit regardless of fluctuations in power supply voltage. For example, a battery used to power a mobile phone may have a decreasing output voltage as the battery loses charge. In this case, the voltage regulator circuit can supply the constant voltage to the load circuit as long as the output voltage of the battery is greater than the constant voltage supplied to the load circuit of the mobile phone. A dropout voltage is then defined as a minimum voltage difference that must be present from an input of the voltage regulator to an output of the voltage regulator for the voltage regulator to supply the constant voltage. For example, a voltage regulator that supplies a constant voltage of 1.8V may be able to supply 1.8V as long as a power supply voltage is above 2.0V, in which case the dropout voltage is 200 mV (2.0V–1.8V). Low dropout regulators (LDOs) are voltage regulators that have a low dropout voltage. In modern applications, LDOs with dropout voltages lower than 50 mV are available.

Please refer to FIG. 1, which is a diagram of an LDO regulator 10 with a first compensation scheme. The LDO regulator 10 comprises a first stage amplifier 101, an inverting amplifier 102, a pass transistor MP, a mirror transistor MS, a current-to-voltage (I-V) convertor 103, a compensation capacitor $C_C$, and a compensation resistor $R_C$. The LDO regulator 10 outputs an output voltage OUT that is nominally constant for all input voltages $V_{DD}$. A load $Z_L$ draws a load current $I_L$ from $V_{DD}$ through the pass transistor MP. A first resistor $R_A$ and a second resistor $R_B$ generates a voltage proportional to OUT that is compared with the reference voltage $V_{REF}$ to control OUT via the amplifiers 101, 102 and the pass transistor MP. The compensation capacitor $C_C$ and the compensation resistor $R_C$ provide frequency compensation that varies with the current outputted by the pass transistor MP due to voltage applied to the compensation resistor $R_C$ through the mirror transistor MS and the I-V convertor 103.

Please refer to FIG. 2, which is a diagram of an LDO regulator 20 with a second compensation scheme. The LDO regulator 20 comprises a first stage amplifier 201, a buffer 202, a pass transistor MP, a first resistor $R_A$, a second resistor $R_B$, a compensation resistor $R_C$, and a compensation capacitor $C_C$. The LDO regulator 20 outputs an output voltage OUT that is nominally constant for all input voltages $V_{REF}$. A load $Z_L$ draws a current from the pass transistor MP. In operation, the LDO regulator 20 is similar to the LDO regulator 10. In addition, the first compensation scheme and the second compensation scheme vary slightly, but are similar in principle.

The LDO regulators 10, 20 described above have a number of drawbacks. First, the PSRR of both of the LDO regulators 10, 20 is not sufficiently high. This can be understood as follows. For the LDO regulator 10 in FIG. 1, a capacitance of value $C_{L1}=(1+A)C_C$ loads the high impedance output terminal X of the first stage to AC ground. For the LDO regulator 20 in FIG. 2, a capacitance of value $C_{L1}=C_C$ loads the high impedance output terminal X of the first stage to AC ground. It is to be noted that for adequate compensation, $C_C$ needs to be large for FIG. 2. Because of this, the PSRR frequency responses of the LDO regulators 10, 20 will each have a zero at $1/2\pi C_{L1}r_{o1}$, where $r_{o1}$ is the output resistance of the first stage.

Secondly, the compensations of the LDO regulators 10, 20 are not applied from the output node OUT. This means that the compensations do not move the output pole to a higher frequency.

Thirdly, the variable compensation resistors $R_C$ of the LDO regulators 10, 20 are MOSFETs. Therefore, in each case, tracking compensation provided by the variable compensation resistor $R_C$ is subject to substantial process variation and temperature variation of the MOSFET.

SUMMARY OF THE INVENTION

According to one embodiment, a low dropout (LDO) regulator comprises an amplifier, a pass transistor, a voltage divider, a compensation network, and a control circuit. The amplifier has a first terminal for receiving a reference signal, a second terminal for receiving a feedback signal, and an output terminal for outputting a comparison result according to the reference signal and the feedback signal. The pass transistor has an input terminal coupled to the output of the amplifier and an output terminal for generating an output current based on the comparison result of the amplifier. The voltage divider is coupled to the pass transistor for generating the feedback signal according to the output current. The compensation network couples the output of the pass transistor to a low-impedance node of the amplifier, and comprises a compensation capacitor and a variable resistor coupled to the compensation capacitor. The control circuit is coupled to the input of the pass transistor and to the variable resistor for controlling resistance of the variable resistor according to the output current of the pass transistor.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
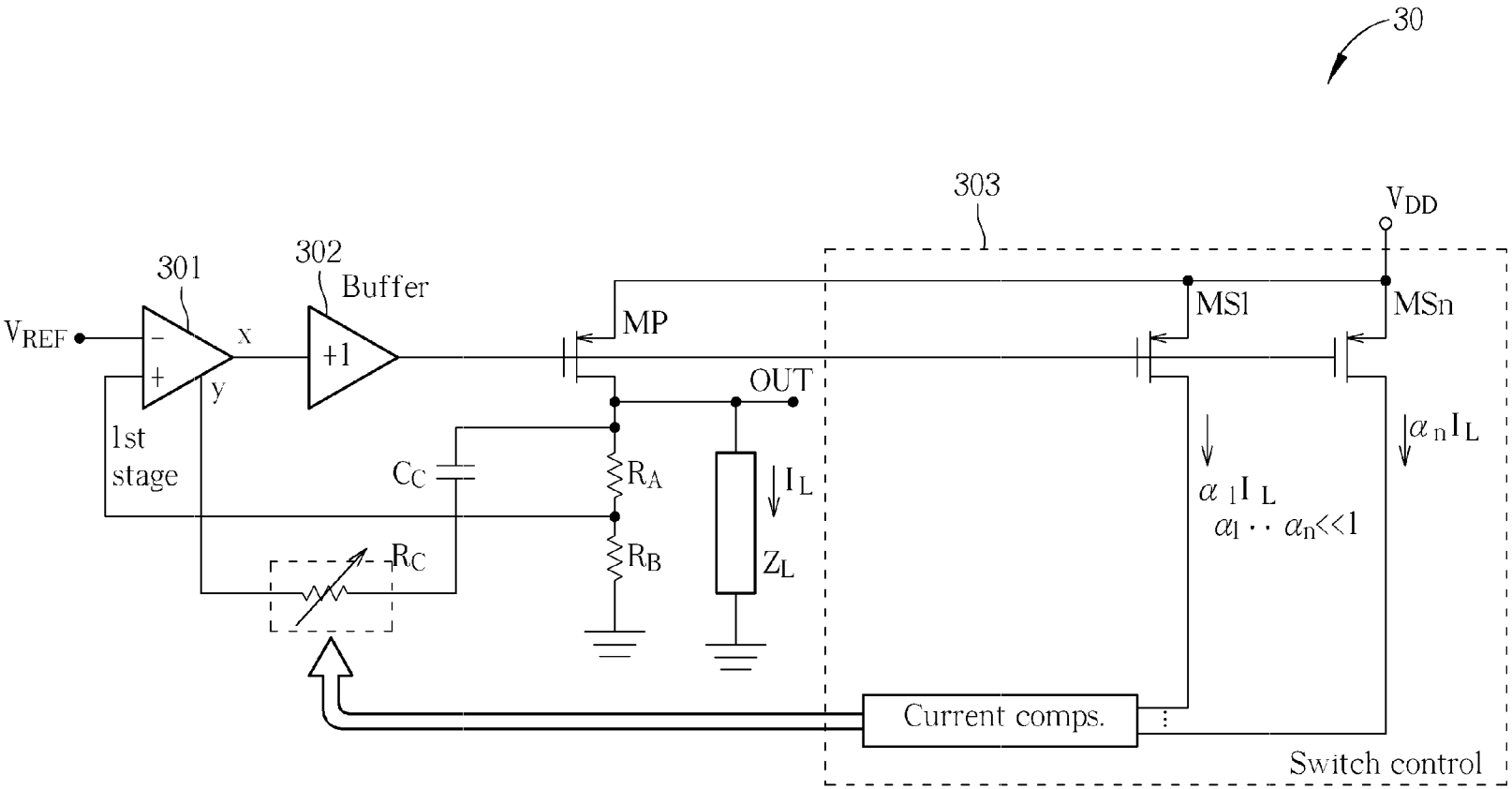
FIG. 3 is a functional diagram of an LDO regulator according to an embodiment of the present invention.

Please refer to FIG. 3, which is a diagram of a low dropout (LDO) regulator 30 according to an embodiment of the present invention. The LDO regulator 30 comprises a first stage amplifier 301, a buffer 302, a pass transistor MP, a first resistor $R_A$ and a second resistor $R_B$. The amplifier has a first terminal (−) for receiving a reference signal $V_{REF}$, a second terminal (+) for receiving a feedback signal, and an output terminal (×) for outputting a comparison result according to the reference signal $V_{REF}$ and the feedback signal. The pass transistor has an input terminal coupled to the output of the amplifier, and an output terminal for generating an output current based on the comparison result of the amplifier. The first resistor $R_A$ and the second resistor $R_B$ form a voltage divider, which is coupled to the pass transistor for generating the feedback signal according to the output voltage OUT. The LDO regulator 30 also comprises a compensation network, which couples the output of the pass transistor MP to a low-impedance node (y) of the amplifier, and comprises a compensation capacitor $C_C$ and a variable resistor $R_C$ coupled to the compensation capacitor $C_C$. A control circuit 303 is coupled to the input of the pass transistor MP and to the variable resistor $R_C$ for controlling resistance of the variable resistor $R_C$ according to the output current of the pass transistor MP.

In FIG. 3, the compensation is applied not to the high impedance output terminal (×), but to a low impedance node (y) of the first stage amplifier 301. Therefore, in this case, CL1=CP1, where CP1 (typically <100 fF) is the parasitic capacitance loading the node X to AC ground, which is much smaller than CL1=(1+A)Cc or Cc (typically >10 pF) for FIGS. 1 and 2, respectively. Therefore, the zero of the PSRR frequency response for FIG. 3 will occur at a much higher frequency compared to those for FIGS. 1 and 2. This means LDO regulator 30 will have better PSRR compared to the LDO regulators 10, 20 at high frequencies.

Figure 4:
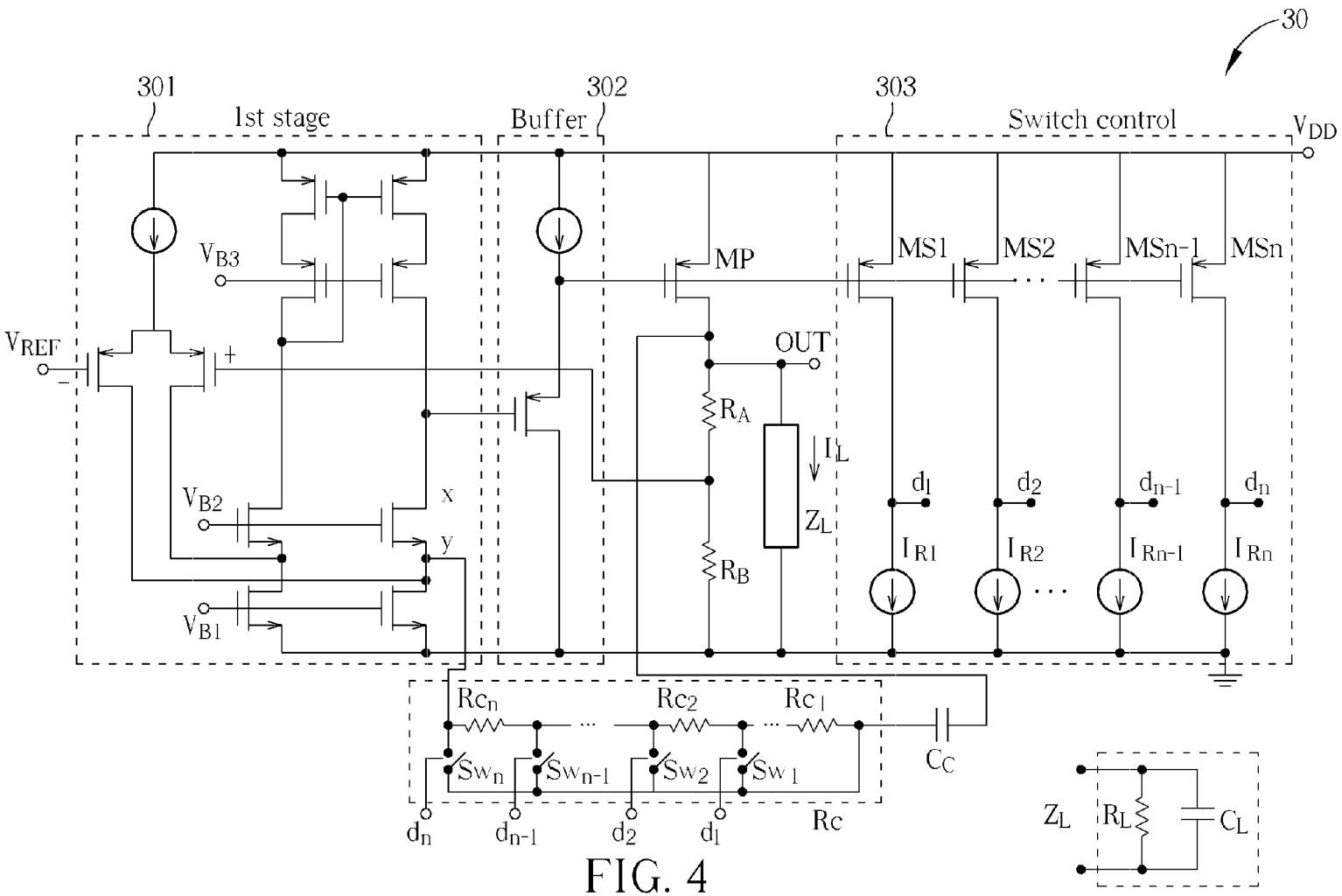
FIG. 4 is a circuit diagram of the LDO regulator of FIG. 3.

Please refer to FIG. 4, which is a detailed schematic of the LDO regulator 30 of FIG. 3. The variable resistor $R_C$ comprises a plurality of resistor sections $R_{C1}$–$R_{Cn}$ forming a resistor series having one end coupled to the compensation capacitor $C_C$ and another end coupled to the low-impedance node (y) of the amplifier. Adjacent resistor sections of the plurality of resistor sections, e.g. $R_{C1}$ and $R_{C2}$, form corresponding internal nodes. The variable resistor $R_C$ further comprises a plurality of switches $SW_1$–$SW_n$. Each switch, e.g. $SW_2$, has an input coupled to the compensation capacitor $C_C$ and an output coupled to a corresponding internal node of the internal nodes.

The control circuit 303 comprises a plurality of transistors (current mirrors) MS1, MS2, . . . , MSn−1, MSn, which are transistors (typically identical in size) each of which carry a small fraction ($\alpha_1$–$\alpha_n$) of the current in the pass transistor MP, which is essentially the load current $I_L$, since the current through RA, RB is negligible. The control circuit 303 further comprises a plurality of current references $I_{R1}$–$I_{Rn}$ ($I_{R1}<I_{R2}<\ldots<I_{Rn-1}<I_{Rn}$), which are temperature independent current references. The MOS transistors $MS_i$ and current sources $I_{Ri}$ (where i=1, 2, . . . , n−1, n) form a plurality of current comparators. Outputs $d_i$ of these comparators may go high whenever the current in $MS_i$ exceeds $I_{Ri}$. The switches $SW_1$, $SW_2$, . . . , $SW_{n-1}$, $SW_n$ may then modify the overall resistance of the compensation resistor $R_C$ by shorting corresponding resistor sections $R_{C1}$–$R_{Cn}$ of the variable resistor $R_C$. $SW_i$ may be closed when $d_i$ is high and open otherwise. It is easy to verify that $R_C=R_{C1}+R_{C2}+\ldots+R_{Cn-1}+R_{Cn}$ (maximum value) when $I_L=0$. As the load current increases, $R_C$ reduces, and finally $R_C=0$ when $I_L$ is maximum.

Looking into stability analysis of the LDO regulator 30 in FIG. 4, the basic idea of high-PSRR compensation (Ahuja compensation) is well known in the art. However, in the LDO regulator 30, the high-PSRR compensation is modified by inclusion of the compensation resistor $R_C$ in series with the compensation capacitor $C_C$. It can be shown with small-signal analysis that the PSRR is not appreciably affected by the presence of $R_C$. However, the resistor $R_C$ needs to be varied to track changes in the poles with changes in the load. The reason for the presence of $R_C$ and the need for its variability are explained below.

Using small-signal analysis, it can be shown that the loop-gain of the LDO has a low-frequency pole $\omega_{p1}$, a high-frequency pole $\omega_{p2}$, and a zero $\omega_z$. When the compensation is proper, then a unity gain frequency $\omega_0$ may be defined. The first three parameters are given by:

$$\omega_{p1} = \frac{1}{r_2C_2 + R_CC_C + g_{m2}r_1r_2C_C} \tag{1}$$

$$\omega_{p2} = \frac{1}{r_1C_1\left[1+\left(\frac{1}{r_1C_1}+\frac{1}{r_2C_2}\right)R_CC_C\right]} + \frac{R_CC_C}{r_1C_1r_2C_2+(r_1C_1+r_2C_2)R_CC_C} + \frac{g_{m2}C_C}{C_1C_2\left[1+\left(\frac{1}{r_1C_1}+\frac{1}{r_2C_2}\right)R_CC_C\right]} \tag{2}$$

$$\omega_z = \frac{1}{R_CC_C} \tag{3}$$

where $g_{m1}$ is transconductance of the first stage, $g_{m2}$ is transconductance of the pass transistor MP, $r_1$ is output resistance of the first stage, $r_2$ is approximately load resistance $R_L$, $C_1$ is parasitic capacitance loading the first stage output, $C_2$ is approximately load capacitance $C_L$, $C_C$ is compensation capacitance, and $R_C$ is compensation resistance. It can be seen from the discussion above that there are two significant poles, and it is known that good stability can be achieved if the poles are kept far apart. However, the zero provided by $R_C$ and $C_C$ can also help improve compensation, which is described later. Generally, good stability is characterized by phase margins $\Phi_m$ from 45° to 90°, the higher the better.

To understand how compensation works, assume that $R_C=0$. Then, (1), (2) and (3) reduce to:

$$\omega_{p1} = \frac{1}{r_2C_2 + g_{m2}r_1r_2C_C} \tag{4}$$

$$\omega_{p2} = \frac{1}{r_1C_1} + \frac{g_{m2}C_C}{C_1C_2} \tag{5}$$

$$\omega_z = \infty \tag{6}$$

For light loading, i.e. when $r_2=R_L$ is very large, $\omega_{p1}$ is very small. On the other hand, $\omega_{p2}$ is large, since the term $g_{m2}C_C/C_1C_2$ is large. In other words, the separation between $\omega_{p1}$ and $\omega_{p2}$ is large and, therefore, adequate $\Phi_m$ is achieved for good stability. For moderately heavy loading, when $r_2=R_L$ is moderately small, $I_L$ is moderately high, and $g_{m2}$ increases, but less than proportionately with $I_L$, because of the square-root relationship. Then, as can be seen from (4) and (5), $\omega_{p1}$ increases more than $\omega_{p2}$ does, and the separation of the poles decreases, reducing $\Phi_m$ and worsening the stability. From (6), the zero $\omega_z$ is not present, which helps to improve the stability. However, at the heaviest loading, $I_L$ is maximum and $g_{m2}$ is substantially large. Then again, from (4) and (5), it can be seen that $\omega_{p1}$ becomes smaller and $\omega_{p2}$ becomes larger, increasing the separation and improving the stability again. From the above discussion, it can be seen that if $R_C$ were not present, then stability would be good at very light and very heavy loads, but poor at intermediate loads.

Figure 7:
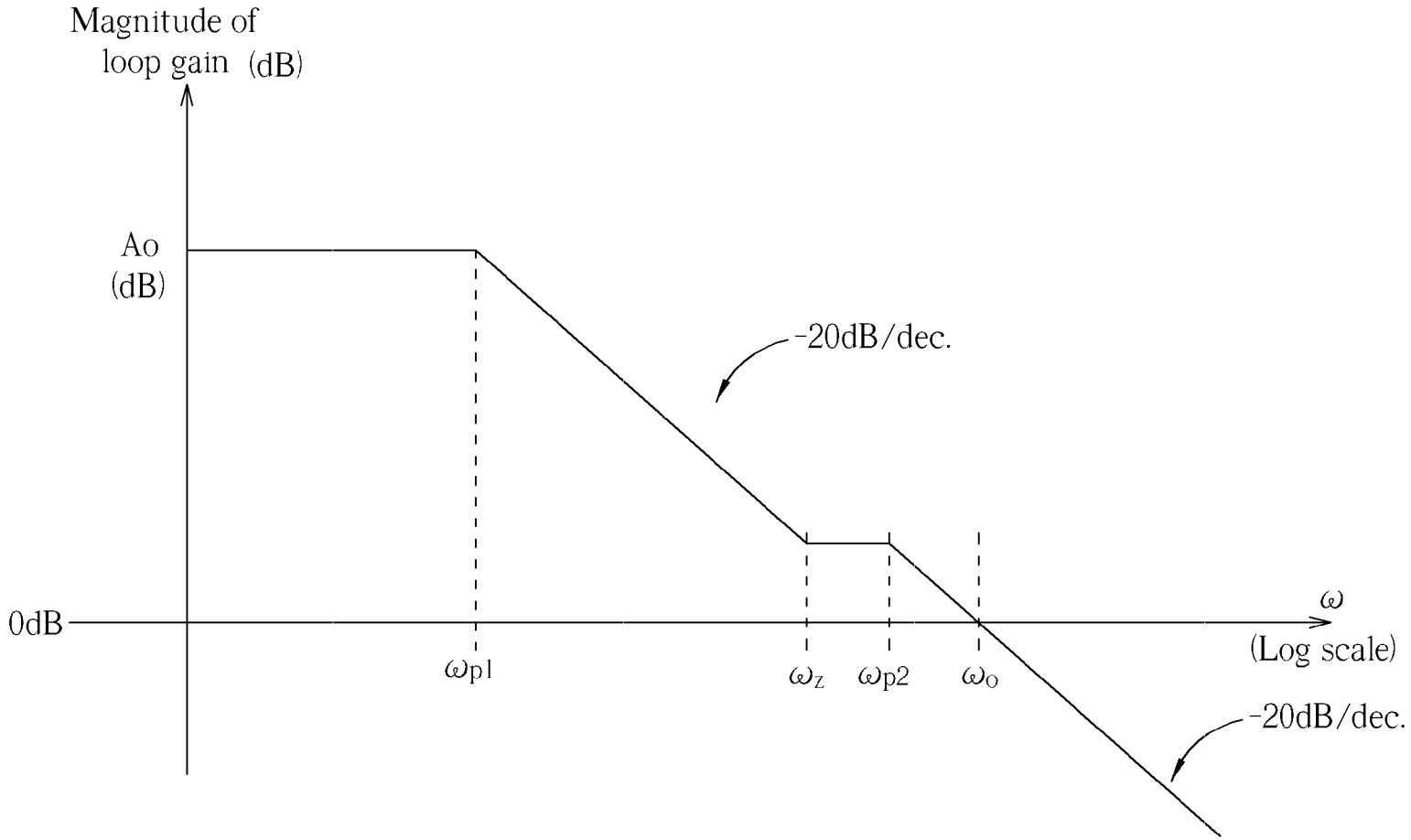
FIG. 7 is a frequency response diagram for the LDO regulator of FIG. 4 under moderate loading.

Assuming $R_C$ is present, (1), (2), and (3) are valid. As can be seen from (1), if $R_C$ is large, $\omega_{p1}$ cannot become very large, and stability is therefore improved for low to moderate loads. However, from (2), it can be seen that a large $R_C$ also does not allow $\omega_{p2}$ to increase when $I_L$ and, consequently, $g_{m2}$ is increased. On the contrary, $\omega_{p2}$ may actually be reduced with increasing $I_L$ as per the first and third terms in (2). Therefore, at high to moderate loads, the pole separation is low, and consequently the stability becomes poor if $R_C$ is high. However, from (3), it can be seen that $R_C$ and $C_C$ provide the zero $\omega_z$ that can be used to improve the stability for moderate loads, when the pole separation is not too large, by placing it near $\omega_{p2}$, as shown in FIG. 7. In conclusion, some finite value of $R_C$, if not too large, is beneficial for stability at moderate loading.

Figure 5:
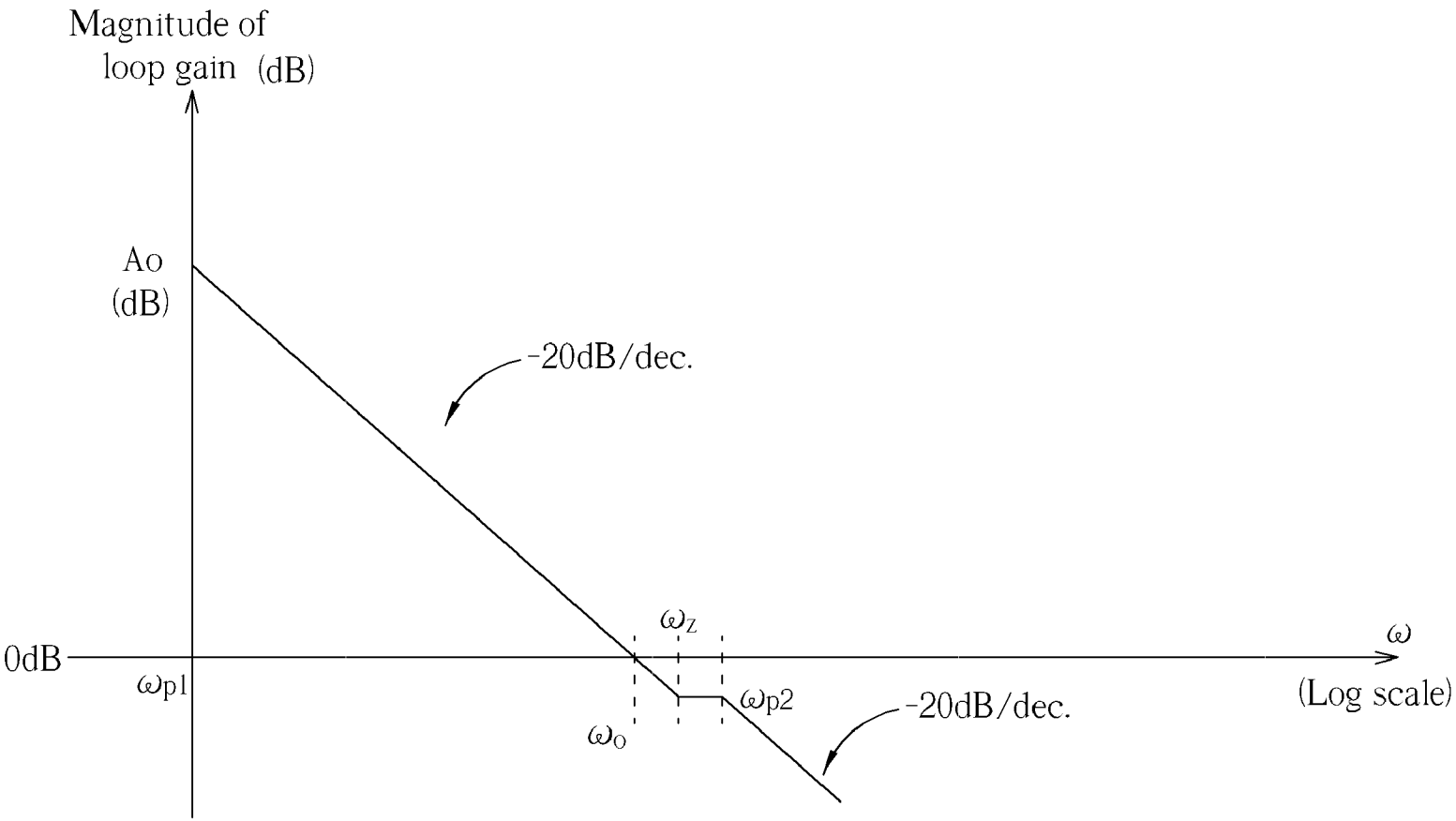
FIG. 5 is a frequency response diagram for the LDO regulator of FIG. 4 under very light loading.
Figure 6:
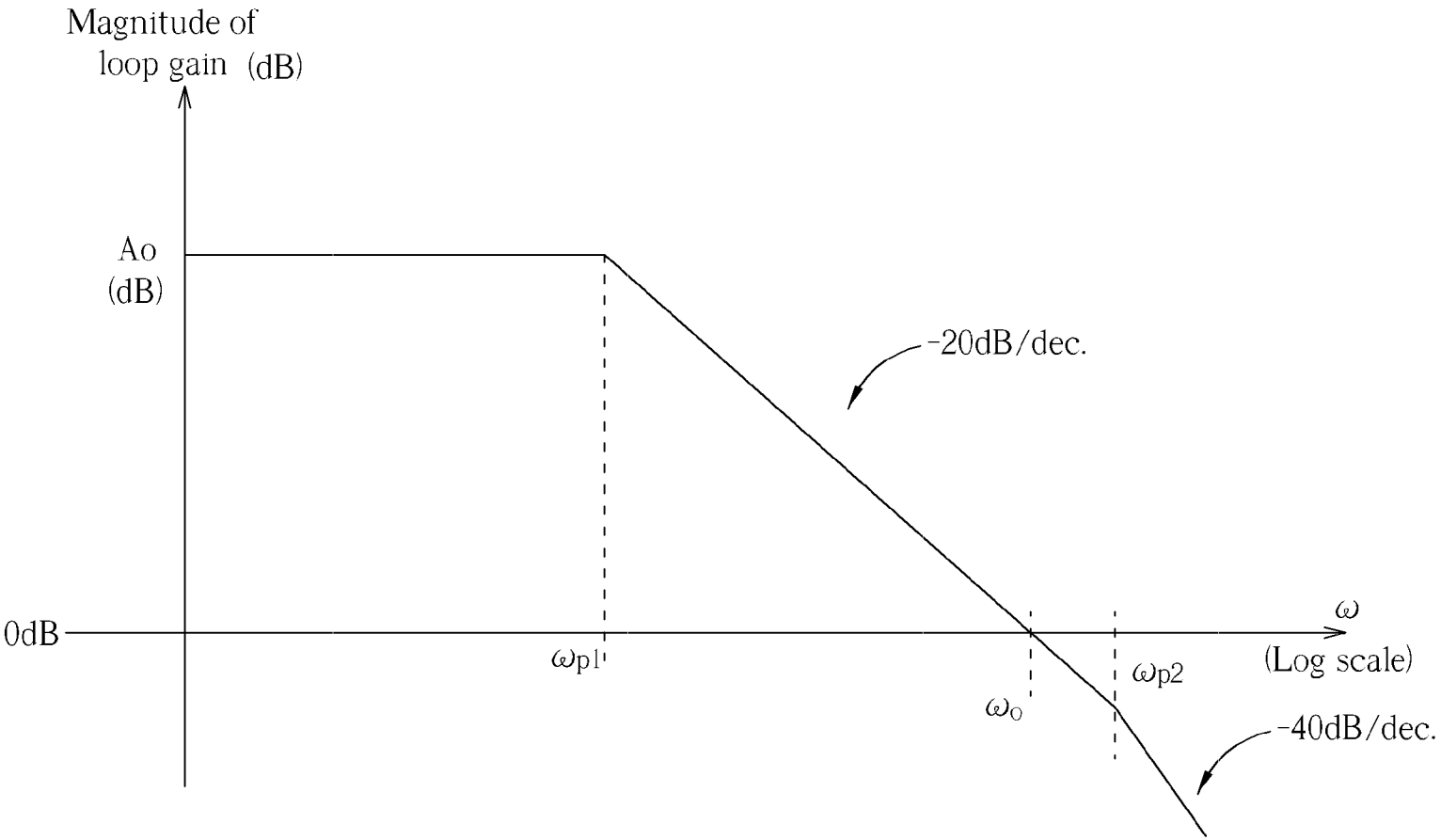
FIG. 6 is a frequency response diagram for the LDO regulator of FIG. 4 under very heavy loading.
Figure 8:
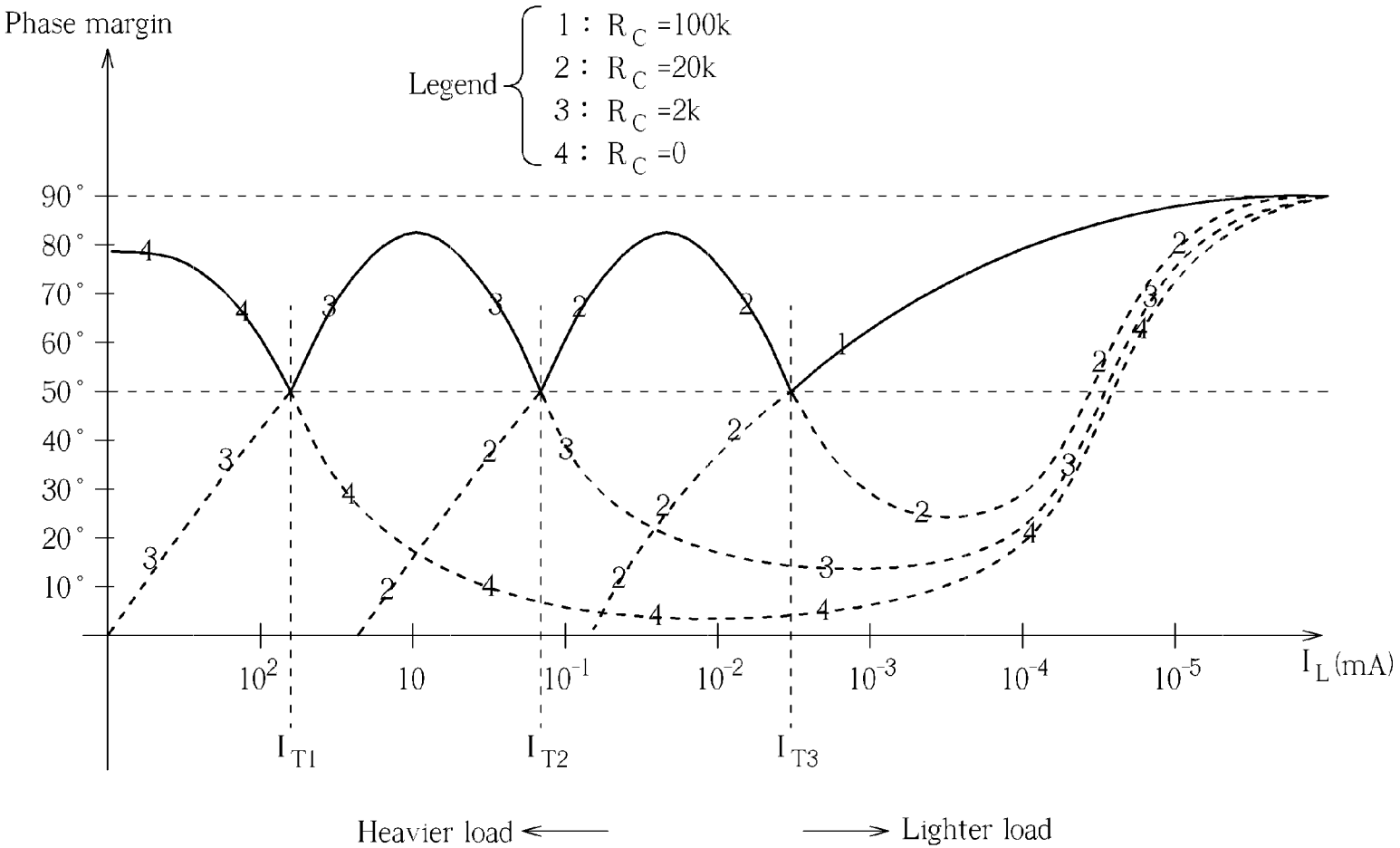
FIG. 8 is a representative plot of phase margin versus load current for the LDO regulator of FIG. 4 for various compensation resistor values.

In summary, it can be seen that a high valued $R_C$ provides good stability at light and low-moderate loads, a low valued $R_C$ provides good stability at high-moderate loads, and a zero valued $R_C$ provides good stability at very heavy loads. FIGS. 5 and 6 show corresponding plots for very light and very heavy loading conditions, respectively. FIG. 8 shows a typical plot of how the phase margin $\Phi_m$ behaves with $I_L$ for four values of $R_C$. Clearly, the phase margin $\Phi_m$ is not adequate for all $I_L$ for any one value of $R_C$. It can also be seen that $I_{T1}$, $I_{T2}$, and $I_{T3}$ are appropriate load current values for switching from one value of $R_C$ to another so that a minimum phase margin Φm of 50° can be maintained for any $I_L$.

Figure 1:
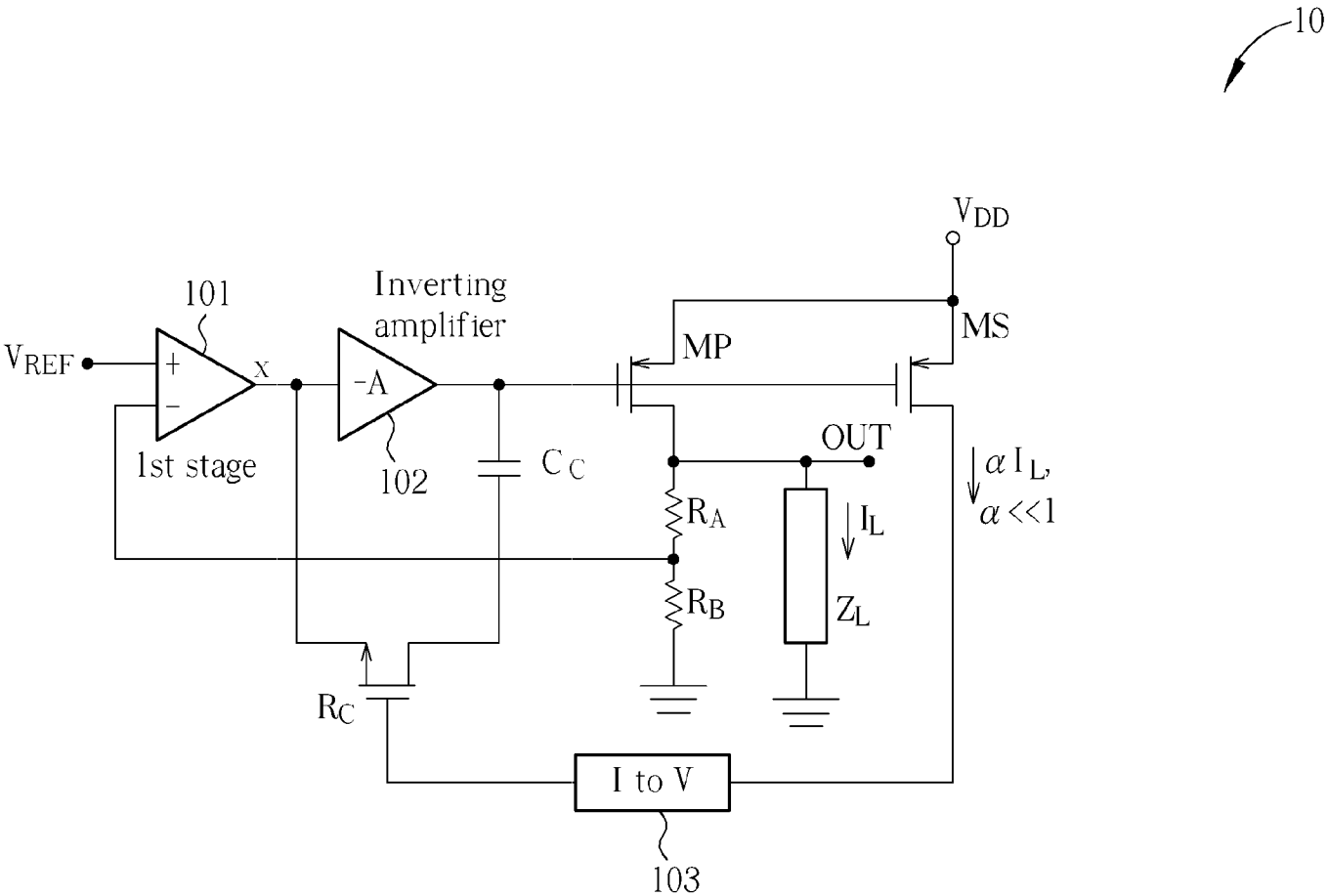
FIG. 1 PRIOR ART
FIG. 1 is a diagram of a low dropout (LDO) regulator with a first compensation scheme according to the prior art.
Figure 2:
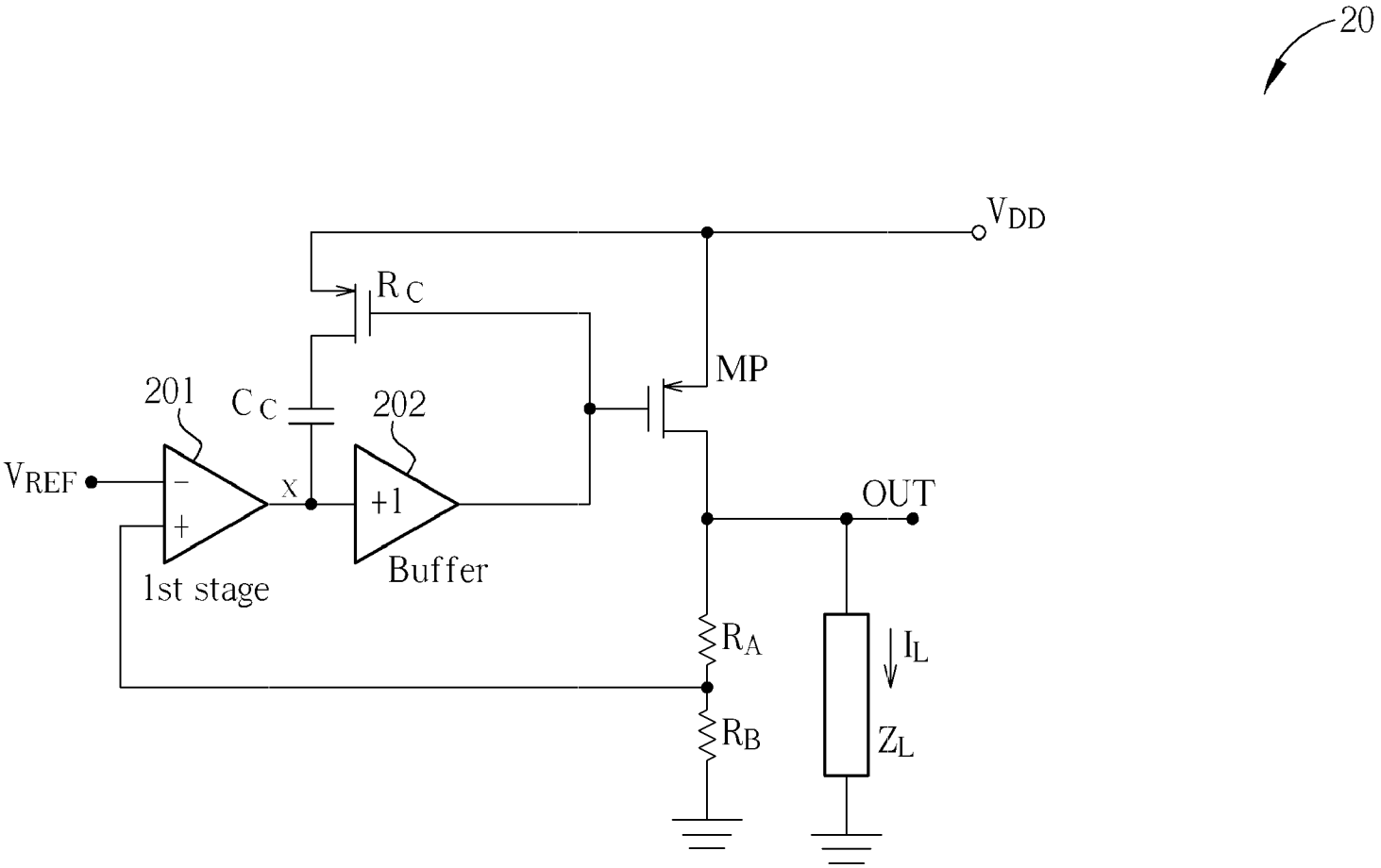
FIG. 2 PRIOR ART
FIG. 2 is a diagram of an LDO regulator with a second compensation scheme according to the prior art.

The compensations of the LDO regulators 10, 20 are not applied from the output node OUT. This means that the compensations do not move the output pole to a higher frequency. However, in the LDO regulator 30, the compensation is actually applied from the output OUT and, therefore, is capable of providing better frequency compensation. Further, the variable compensation resistor $R_C$ in FIGS. 1-2 are MOSFETs. Therefore, in each case, the tracking compensation provided by this resistor is subject to substantial process and temperature varations of the MOSFET. However, in FIG. 3, $R_C$ is a poly resistor, and is digitally switched in response to a predetermined value of the load current $I_L$ using the control circuit 303 that contains current comparators with accurate current references and, therefore, provides a more stable solution.

Those skilled in the art will readily observe that numerous modifications and alterations of the device and method may be made while retaining the teachings of the invention.

What is claimed is:

1. A low dropout (LDO) regulator comprising:

an amplifier having a first terminal for receiving a reference signal, a second terminal for receiving a feedback signal, and an output terminal for outputting a comparison result according to the reference signal and the feedback signal;

a pass transistor having an input terminal coupled to the output of the amplifier and an output terminal for generating an output current based on the comparison result of the amplifier;

a voltage divider coupled to the pass transistor for generating the feedback signal according to the output current;

a compensation network coupling the output of the pass transistor to a low-impedance node of the amplifier, the compensation network comprising a compensation capacitor and a variable resistor coupled to the compensation capacitor; and a control circuit coupled to the input of the pass transistor and the variable resistor for controlling resistance of the variable resistor according to the output current of the pass transistor.

2. The LDO regulator of claim 1, wherein the variable resistor comprises:

a plurality of resistor sections forming a resistor series having one end coupled to the compensation capacitor and another end coupled to the low-impedance node of the amplifier, adjacent resistor sections of the plurality of resistor sections forming corresponding internal nodes; and a plurality of switches, each switch having an input coupled to the compensation capacitor and an output coupled to a corresponding internal node of the internal nodes.

3. The LDO regulator of claim 2, wherein the control circuit comprises a plurality of current comparators, each current comparator comprising:

a current mirror coupled to the input of the pass transistor for mirroring the output current; and a current reference coupled to the current mirror and a corresponding switch of the plurality of switches for shorting a corresponding resistor section of the plurality of resistor sections according to a current comparison result of the current reference and the current mirror.

4. The LDO regulator of claim 2, wherein the plurality of resistor sections is a plurality of poly resistors.

5. The LDO regulator of claim 1, further comprising:

a buffer having an input terminal coupled to the output terminal of the amplifier and an output terminal coupled to the input terminal of the pass transistor for outputting the comparison result of the amplifier to the pass transistor.

6. The LDO regulator of claim 1, wherein the voltage divider comprises:

a first resistor; and a second resistor coupled to the first resistor.

7. The LDO regulator of claim 3, wherein the plurality of resistor sections is a plurality of poly resistors.

8. The LDO regulator of claim 3, further comprising:

a buffer having an input terminal coupled to the output terminal of the amplifier and an output terminal coupled to the input terminal of the pass transistor for outputting the comparison result of the amplifier to the pass transistor.

9. The LDO regulator of claim 3, wherein the voltage divider comprises:

a first resistor; and a second resistor coupled to the first resistor.

* * * * *